United States Patent [19]

Ahumada

[11] 4,400,595

[45] Aug. 23, 1983

[54] MEMBRANE SWITCH ASSEMBLY

[75] Inventor: Jorge S. Ahumada, Mesa, Ariz.

[73] Assignee: Rogers Corporation, Rogers, Conn.

[21] Appl. No.: 268,008

[22] Filed: May 28, 1981

[51] Int. Cl.[3] ..... H01H 13/04

[52] U.S. Cl. ..... 200/5 A; 200/159 B; 200/306

[58] Field of Search ..... 200/5 R, 5 A, 86 R, 200/159 B, 306

[56] References Cited

U.S. PATENT DOCUMENTS 3,294,927 12/1966 Hill ..... 200/5 R 4,046,975 9/1977 Seeger, Jr. ..... 200/306 X

*Primary Examiner*—J. R. Scott

*Attorney, Agent, or Firm*—David S. Fishman

[57] ABSTRACT

A membrane switch assembly wherein the internal pressure is automatically equalized with the external pressure through the use of a self-regulating vent. The vent is defined by a non-linear slit formed in an outer layer of the membrane switch assembly, the slit producing a normally closed valve which is caused to open by a pressure differential between the internal pressure and the external pressure.

11 Claims, 5 Drawing Figures

MEMBRANE SWITCH ASSEMBLY

BACKGROUND OF THE INVENTION (1) Field of the Invention

The present invention relates to improved membrane switch assemblies and specifically to membrane switch assemblies having internal cavities that are vented to the external environment in response to a pressure differential. More particularly, the present invention is directed to a technique for automatically compensating for pressure differences across flexible members which carry switch contacts and particularly members which in part define switches of an array of the type found in miniaturized keyboards. Accordingly, the general objects of the present invention are to provide novel and improved methods and articles of such character.

(2) Description of the Prior Art

Prior art membrane switch assemblies, such as switch arrays of the type employed in data entry keyboards, are typically constructed by laminating a spacer sheet between two printed circuit "boards", at least one of the "boards" being flexible. The substrate sheets of the printed circuits boards are positioned so that conductors thereon face each other. The switches are defined by providing the spacer sheet with apertures so that conductors of the spaced printed circuits can be urged into contact with each other. These prior art membrane switch assemblies were usually constructed so that the apertures in the spacer sheet formed cavities that were permanently sealed off from the surrounding environment. These cavities were usually filled with a fluid, primarily air.

The above-described prior art method of constructing membrane switch assemblies resulted in certain disadvantages. The major disadvantage, which was caused by hermetically isolating the interior of the cavities from the ambient atmosphere, was manifested when there was a change in the outside fluid pressure, for example the atmospheric pressure. If the machine which incorporates the membrane switch assembly was operated at an altitude where the atmospheric pressure is less than the cavity internal pressure, the greater internal pressure exerted an outward force upon the layers of the laminate comprising the printed circuit. The result of this outwardly directed force was a cushioning effect to the operation of the individual switches or keys. As the outside atmospheric pressure continues to drop the pressure within the cavities caused continued outward expansion and further interfered with the activation of the keys. In some situations the touch sensitivity may become so low that it will become difficult to determine by feel whether the key has been activated. In the extreme situation, with a very large differential between the outside atmospheric pressure and the pressure within the cavities, the membrane switch assembly may become distorted with some structural damage being caused by the outward expansion resulting from the pressure differential across the laminate walls.

A similar result occurs when the outside atmospheric pressure becomes greater than the pressure within the cavities. Such a reverse pressure differential will, for example, result when the mechanism incorporating the membrane switch assembly is located in a high pressure environment. Under these conditions the forces exerted upon the walls of the laminate will distort the walls of the laminate outwardly. In an extreme condition, when the pressure differential between the external pressure and the internal pressure becomes great, the switch may be activated by the walls of the laminate coming into contact with one another.

Another disadvantage in the construction of prior art membrane switch assemblies is apparent even under normal or expected operating conditions. The gas trapped within the cavities, being substantially non-compressible, provides resistance to compression of the walls of the laminate when a user trys to activate the keys. This results in a cushioning effect which is felt by the user of the membrane switch assembly. While under certain circumstances this may be a desirable effect, it may also reduce the users ability to either activate the key or "feel" that a switch closure has been achieved.

The prior art discloses methods which have been utilized to try to alleviate the above-discussed disadvantages of membrane switch assemblies. One such prior method involves incorporating internal passageways, within the spacer sheet, between the cavities. This allows displacement of the fluid medium, particularly air, between the internal cavities of the membrane switch assembly. When one key is activated the fluid within that cavity will be displaced by the downward movement of the membrane wall through the passageways into one or more other cavities. While the use of labyrith passageways will reduce the cushioning effect caused by the resistance to the downward deflection of the membrane wall of the trapped gas, it will not totally alleviate the problem. Further, problems resulting from a pressure differential between the outside atmospheric pressure and the internal switch assembly pressure were not solved by the use of labyrinth passageways. The pressure differential affects the passageways in the same fashion as it affects the individual isolated cavities.

A further technique for overcoming the above-discussed disadvantages suggested in the prior art involved permitting equalization of the internal fluid pressure with the external fluid pressure. This technique, in one form, requires providing a hole or plural holes in at least one of the outer layers of the membrane switch assembly. The hole or holes allows air, or any other fluid medium in which the switch assembly is operated, to flow freely into and out of the cavities. When the external pressure drops, gas will flow out of the cavities into the surrounding environment. When the situation is reversed, and the external atmospheric pressure is greater, gas flows into the cavities of the switch assembly. While this method solves the problems of the prior art membrane switch assemblies caused by differentials between the external and internal pressures, it created other significant disadvantages.

The major problem associated with providing a hole through an outer layer of the assembly is internal contamination. With air or other gas constantly flowing into and out of the membrane switch assembly, airborne contaminates are deposited within the assembly cavities. These airborne contaminates include dust, water vapor and airborne chemical contaminates. These contaminates cause deterioration of the switch assemblies particularly the conductive circuits. Water vapor, for example, will cause oxidation of the conductive circuits. It may also be possible that the walls of the assembly will deteriorate, depending upon the type of chemical contaminate present. This deterioration of the assembly shortens its lifespan and thus results in additional operating cost incident to repair or replacement.

A basic problem with prior art membrane switch assemblies is thus the need to provide means to stabilize and equalize the pressure differential across the printed circuit boards that carry the moveable switch contacts without allowing deterioration of the switch assembly by airborne contaminates. It is also recognized that any method devised to solve this problem will have to be characterized by reliability and minimum added production cost. If the solution to the problem resulted in a more cumbersome and expensive switch assembly, the usefulness of the membrane switch assembly would be impaired.

Accordingly, the general objects of the present invention are to overcome the above-discussed and other disadvantages of the prior art without reducing the usefulness or economic attractiveness of the membrane switch assembly.

SUMMARY OF THE INVENTION

The present invention overcomes the above-enumerated disadvantages and other deficiencies of the prior art by providing a novel membrane switch assembly which incorporates normally closed valve means for equalizing internal and external fluidic pressure and minimizing internal contamination. Furthermore, the present invention provides self-regulating means for equalizing the internal and external pressure. The present invention also reduces significantly the internal contamination by airborne contaminates of a membrane switch assembly which is opened to the ambient environment.

An improved membrane switch assembly in accordance with the present invention incorporates a self-regulating vent in an external layer of the switch assembly. This self-regulating vent remains closed when the pressure differential between the external and internal fluid pressures is insignificant. When the internal fluid pressure exceeds the external fluid pressure by a significant degree, the force exerted on the self-regulating vent forces it open. The same result occurs when the external fluid pressure exceeds the internal fluid pressure.

The self-regulating vent also opens when a key in fluid communication therewith is activated. When the user activates the key the fluid within the cavity is displaced by the downward movement of the laminate wall. This downward movement causes an increase in cavity pressure and thus forces open the vent. Once the key is deactivated the laminate wall returns to its normal position. The result is a reduced internal fluid pressure caused by the loss of fluid through the vent when the key was activated. With the external pressure now exceeding the internal pressure the vent will open and the pressure differential will be equalized. Thus the self-regulating vent is controlled by the pressure differential between the external and internal fluid pressure. Internal contamination is reduced by the vent maintaining a closed position when the pressure differential between the external and internal pressure is insignificant.

The self-regulating vent of the present invention is formed in an outer layer of the membrane switch assembly by providing a slit within the appropriate area or areas of the layer. While the preferred arrangement is a slit of arcuate configuration, any arrangement is possible so long as the slit is non-linear and thus defines a flap.

The positioning of the self-regulating vent or vents is dependent upon the internal construction of the membrane switch assembly. In positioning the self-regulating vent of the present invention it is important to understand that each cavity must have access to at least one self-regulating vent. The self-regulating vents may also be positioned on either side of the membrane switch assembly laminate so long as they are provided within a layer which is exposed to the ambient environment.

BRIEF DESCRIPTION OF THE DRAWINGS

The present invention will be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

The present invention relates to a novel membrane switch assembly which incorporates means for equalizing the differential between the external atmospheric pressure and the internal cavity pressure. It will be apparent to those skilled in the art that, while the ambient environment will typically be air, the novel switch assembly of the present invention may be used in other fluid mediums.

Figure 1:
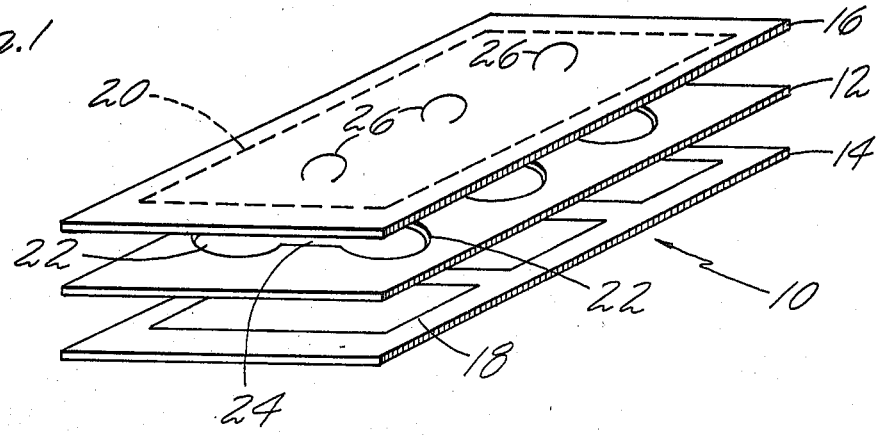
FIG. 1 is a schematic exploded view of one embodiment of the present invention.

Referring now to FIG. 1, an exploded view of one embodiment of the membrane switch assembly of the present invention is indicated generally at 10. In the preferred embodiment of the present invention assembly 10 is comprised of non-conductive spacer sheet 12 and printed circuit boards or sheets 14 and 16. Sheets 14 and 16 are non-conductive and have conductive circuit patterns 18 and 20, respectively, supported on at least one side thereof. Circuit patterns 18 and 20 may be formed on sheets 14 and 16 by any known method, such as by selective etching of a copper film or by using conductive ink. Sheets 14 and 16 are arranged so that circuit patterns 18 and 20 face each other and are partly in registration. In use, when an appropriate point on circuit pattern 18 contacts an appropriate point on circuit pattern 20, a current flows from one to the other. In order to permit contact to be selectively established between circuit patterns 18 and 20, spacer sheet 12 is provided with apertures 22. These apertures 22 are positioned within spacer sheet 20 so as to allow the appropriate portions of circuit patterns 18 and 20 to be brought into contact with each other when the portions of either or both of circuitry sheets 14 and 16 which are aligned with the apertures are inwardly deflected. The total arrangement is a series or array of normally open switches. Each switch is defined by appropriate sections of circuit patterns 18 and 20 which, when the switches are closed, may be urged into contact through the appropriate aperture 22.

In the disclosed embodiment of the present invention a pair of apertures 22 are interconnected by passageway 24 formed in spacer sheet 12. It should be apparent to those skilled in the art that more than a pair of apertures 22 may be interconnected by a passageway 24. It would be possible, for example, to connect a series of three or more apertures 22 by two or more passageways 24. Furthermore, it would be appropriate to provide spacer sheet 12 with one large aperture instead of defining each individual switch with an independent aperture 22. As will later become apparent to those skilled in the art, the arrangement of self-regulating vents in accordance with the invention is dependent upon the arrangement of apertures 22 and passageways 24.

In the preferred embodiment of the present invention, self-regulating vents 26 are formed in printed circuit supporting sheet 16. As will be discussed below, while the preferred embodiment of the self-regulating vents 26 comprises a slit which transcribes an arc of a circle of greater than 180° length, other configurations are possible. Thus, the vents 26 define flaps which are located within circuitry sheet 16 so that they are directly above passageways 24.

Figure 2:
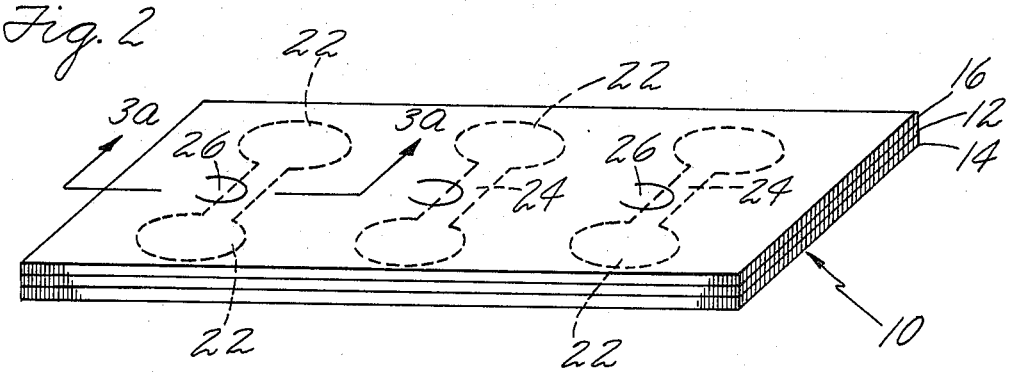
FIG. 2 is a perspective view of the embodiment of FIG. 1.

Referring now to FIG. 2, an assembled membrane switch assembly 10 is seen. Sheets 14 and 16 are permanently bonded to spacer sheet 12. Apertures 22 and passageways 24 are normally isolated from the surrounding environment, to form internal cavities, and these cavities may be placed in communication with the surrounding environment through self-regulating vents 26. Self-regulating vents 26 equalize the pressure within the cavities defined in part by apertures 22 and passageways 24 with the ambient pressure. It should be apparent to those skilled in the art that self-regulating vents 26 could have alternatively been formed in sheet 14. It should also be apparent to those skilled in the art that, in the absence of passageways 24, each aperture 22 will be provided with a self-regulating vent 26. Furthermore, it should be apparent to those skilled in the art that the positioning of self-regulating vents 26 is dependent upon the configuration of apertures 22 and passageways 24. It is possible to provide one self-regulating vent 26 for a series of aperture 22 interconnected by a series of passageways 24. It is also possible to provide one self-regulating vent 26 for a group of individual switches that are defined by one large aperture 22. The only requirement of the present invention is that the pressure within each cavity formed by apertures 22 be capable of being equalized with the external atmospheric pressure through at least one self-regulating vent 26.

Figure 3A:
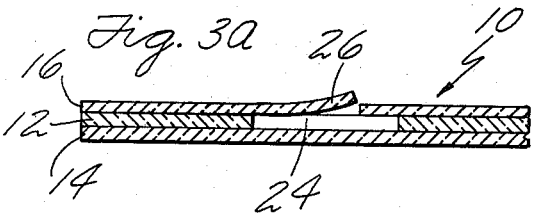
FIG. 3A is a cross-sectional view of the self regulating vent of the present invention taken along line 3*a*—3*a* of FIG. 2 under one operative condition.
Figure 3B:
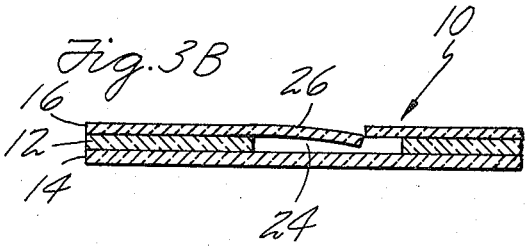
FIG. 3B is a view similar to FIG. 3A showing another operative condition.

Referring now to FIGS. 3A and 3B, a cross-sectional view through a self-regulating vent 26 of membrane switch assembly 10 is seen. The activation of self-regulating vents 26 is a function of the pressure differential across the printed circuit supporting sheet 16. FIG. 3A illustrates the position of self-regulating vent 26 when the pressure within the cavities exceeds the external or ambient pressure by a significant amount. When the pressure within the cavities exceeds the external atmospheric pressure the force exerted upon the inwardly facing surface of vent 26 exceeds the force exerted upon the outwardly facing surface and the vent 26 is caused to open. This allows the air within the cavity is escape through self-regulating vent 26 until the pressure is equalized. FIG. 3B illustrates the opposite situation, when the external atmospheric pressure exceeds the internal cavity pressure. With the force exerted on the outer surface of self-regulating vent 26 being significantly greater than the force exerted on the inner surface, self-regulating vent 26 is opened. This allows air to enter the cavity until the pressure is equalized. The opening and closing of self-regulating vents 26 involves the movement of that portion of circuitry sheet 16 defined by the slit either inwardly or outwardly depending upon the pressure differential. The point at which the vent opens will be a function of the pressure differential, the size of the vent and the characteristics of the plastic sheet material which forms the printed circuit substrate. Thus, the activation pressure may be selected so as to be greater than a minimum pressure differential whereby the vents will remain closed except under conditions which are extreme and/or during switch (key) operation.

Self-regulating vents 26 are primarily activated under two circumstances. The first involves an increase or decrease of the external atmospheric pressure due to the altitude at which assembly 10 is located. The other condition which activates self-regulating vents 26 is when the user of assembly 10 momentarily depresses either of circuitry sheets 14 or 16 to activate a specific key. In both conditions the internal pressure is either significantly greater or less than the external pressure.

Figure 4:
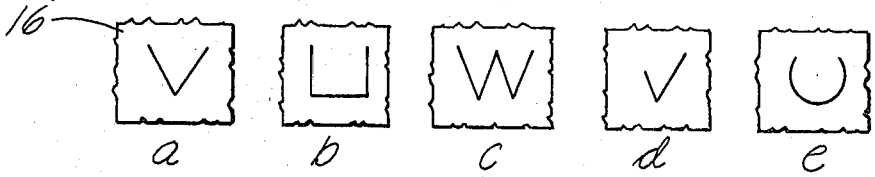
FIG. 4 is a top view of various additional embodiments of the self-regulating vent of the present invention.

Referring to FIG. 4, configurations of self-regulating vents 26 other than arcuate are seen. While the preferred embodiment of self-regulating vents 26 is an arcuate slit, it should be apparent to those skilled in the art that any appropriate slit which will define a flap within a circuitry sheet or any outer layer of a membrane switch assembly would be appropriate. As should also be apparent to those skilled in the art, the configuration of self-regulating vents 26 must be a non-linear in order to provde such a flap. FIG. 4 illustrates only some of the possible configurations for self-regulating vents 26.

While the preferred embodiments have been described and illustrated, various modifications and substitutions may be made thereto without departing from the spirit and scope of the invention. Accordingly, it must be understood that the present invention has been described by way of illustration and not by limitation.

What is claimed is:

1. A switch assembly comprising:

first circuit means, said first circuit means comprising a flexible planar non-conductive substrate having a conductive circuit pattern supported on at least a first surface thereof;

second circuit means, said second circuit means including a non-conductive substrate having a conductive circuit pattern supported on at least a first surface thereof, said circuit pattern of said second circuit means facing said circuit pattern of said first circuit means and being at least partly in registration therewith;

non-conductive spacer means, said spacer means being disposed between said first and second circuit means, said spacer means including at least a first aperture extending therethrough, said aperture being aligned with registered circuit portions of said circuit means whereby electrical contact between registered portions of said said circuit pattern of said first circuit means and said circuit pattern of said second circuit means may be established through said spacer means aperture, said aperture cooperating with said circuit means to define a cavity between said first and said second circuit means; and self-regulating vent means, said self-regulating vent means preventing establishment of a pressure differential greater than a preselected level between the interior of said cavity and the ambient environment, said self-regulating vent means being activated by the pressure differential between the interior of said cavity and the ambient environment, said self-regulating vent means comprising:

a non-linear slit, said slit being provided within said first circuit means, said slit forming a flap, said slit being located in the portion of the said first circuit means which defines said cavity.

2. The switch assembly of claim 1 wherein said non-linear slit is in the form of an arc of a circle of length greater than 180°.

3. The improved membrane switch assembly of claim 1 wherein said non-linear slit is in the form of a V.

4. The improved membrane switch assembly of claim 1 wherein said non-linear slit is in the form of a check.

5. The improved membrane switch assembly of claim 1 wherein said non-linear slit is in the form of a W.

6. The improved membrane switch assembly of claim 1 wherein said spacer means includes a plurality of apertures and further includes at least first passageway means, said passageway means connecting at least a pair of said apertures said apertures and passageway means defining said cavity.

7. The improved membrane switch assembly of claim 6 wherein said non-linear slit is positioned within the portion of said first circuit means which overlies said passageway means.

8. The improved membrane switch assembly of claim 7 wherein said non-linear slit means is in the form of an arc of a circle of length greater than 180°.

9. The improved membrane switch assembly of claim 7 wherein said non-linear slit is in the form of a V.

10. The improved membrane switch assembly of claim 7 wherein said non-linear slit is in the form of a check.

11. The improved membrane swich assembly of claim 7 wherein said non-linear slit is in the form of a W.

* * * * *